US005520441A

United States Patent [19]

Citton

[11] Patent Number: 5,520,441

[45] Date of Patent: May 28, 1996

[54] DEVICE FOR FIXING THE BACK OF A CHAIR OR THE LIKE TO THE SUPPORTING STRUCTURE

[75] Inventor: Napoleone Citton, Borso Del Grappa, Italy

[73] Assignee: N. Citton & C. S.a.s., Borso Del Grappa, Italy

[21] Appl. No.: 352,737

[22] Filed: Dec. 2, 1994

[30] Foreign Application Priority Data

Dec. 7, 1993 [IT] Italy ..... PD93U0147 U

[51] Int. Cl.[6] ..... A47C 7/00

[52] U.S. Cl. ..... 297/440.21; 297/463.1

[58] Field of Search ..... 297/440.1, 440.2, 297/440.16, 410, 397, 440.21, 353, 463.1; 248/222.1, 223.4, 224.1, 224.2

[56] References Cited

U.S. PATENT DOCUMENTS

| | | | |
|---|---|---|---|
| 3,377,966 | 4/1968 | Bates et al. | 297/344.18 X |
| 3,596,861 | 8/1971 | Baldini | 248/223.4 |
| 4,221,430 | 9/1980 | Frobose | 297/410 X |
| 4,451,084 | 5/1984 | Seeley | 297/410 X |
| 4,616,877 | 10/1986 | Slaats et al. | 297/410 X |
| 4,844,541 | 7/1989 | Laird | 297/440.21 X |
| 5,007,678 | 4/1991 | DeKraker | 297/410 X |

FOREIGN PATENT DOCUMENTS

| | | |
|---|---|---|
| 589731 | 6/1947 | United Kingdom . |
| 972460 | 10/1964 | United Kingdom . |

*Primary Examiner*—Milton Nelson, Jr.
*Attorney, Agent, or Firm*—Guido Modiano; Albert Josif

[57] ABSTRACT

A device for fixing the back of a chair or the like to a supporting structure. The device comprises, at the end of a vertical portion of the support of the back, two oppositely arranged elastically retractable pins which are suitable to fit in corresponding seats of shoulders which extend from the internal structure of the back and between which the end is suitable to be inserted and guided.

17 Claims, 3 Drawing Sheets

11
24
27
24
25
26
26
26
26
15
17
17
19
16

18
22
21
11
25
18
26
17
23
20
26
26
23
17
24
20
19
24

29
19
17
15a
27
11
25
15

DEVICE FOR FIXING THE BACK OF A CHAIR OR THE LIKE TO THE SUPPORTING STRUCTURE

BACKGROUND OF THE INVENTION

The present invention relates to a device for fixing the back of a chair or the like to the supporting structure.

In some types of currently commercially available office chairs, the seat and the back are mounted on the ends of an L-shaped support.

The back is substantially composed of an internal supporting structure which is provided, in an upward region, with a padding and a covering and is closed, in a downward region, by a covering shell which is made of plastics and has, at the rear, an opening for the passage of the corresponding end of the L-shaped support.

This technical configuration entails that the various parts that compose the back are assembled during the final assembly of the chair, since it is impossible to work inside the back to fix the support.

The manufacturers of the various components of the chairs must therefore supply loose parts or in any case parts that are only partially assembled, and this is a hardly negligible drawback in the field.

SUMMARY OF THE INVENTION

Therefore, an aim of the present invention is to provide a fixing device that allows the manufacture of backs that are already assembled and are ready to easily and quickly compose chairs or the like in the combinations desired by the dealer.

A consequent primary object is to provide a device that allows sturdy and reliable fixing.

Another important object is to provide a fixing device which is simple to manufacture and has a low cost.

This aim, these objects, and others which will become apparent hereinafter are achieved by a device for fixing the back of a chair or the like to the supporting structure, characterized in that it comprises, at the end of a vertical portion of the support of the back, two oppositely arranged elastically retractable pins which are suitable to fit in corresponding seats of shoulders which extend from the internal structure of the back and between which said end is suitable to be inserted and guided.

BRIEF DESCRIPTION OF THE DRAWINGS

Further characteristics and advantages of the invention will become apparent from the following detailed description of an embodiment thereof, illustrated only by way of non-limitative example in the accompanying drawings, wherein.

DESCRIPTION OF THE PREFERRED EMBODIMENTS

Figure 1:
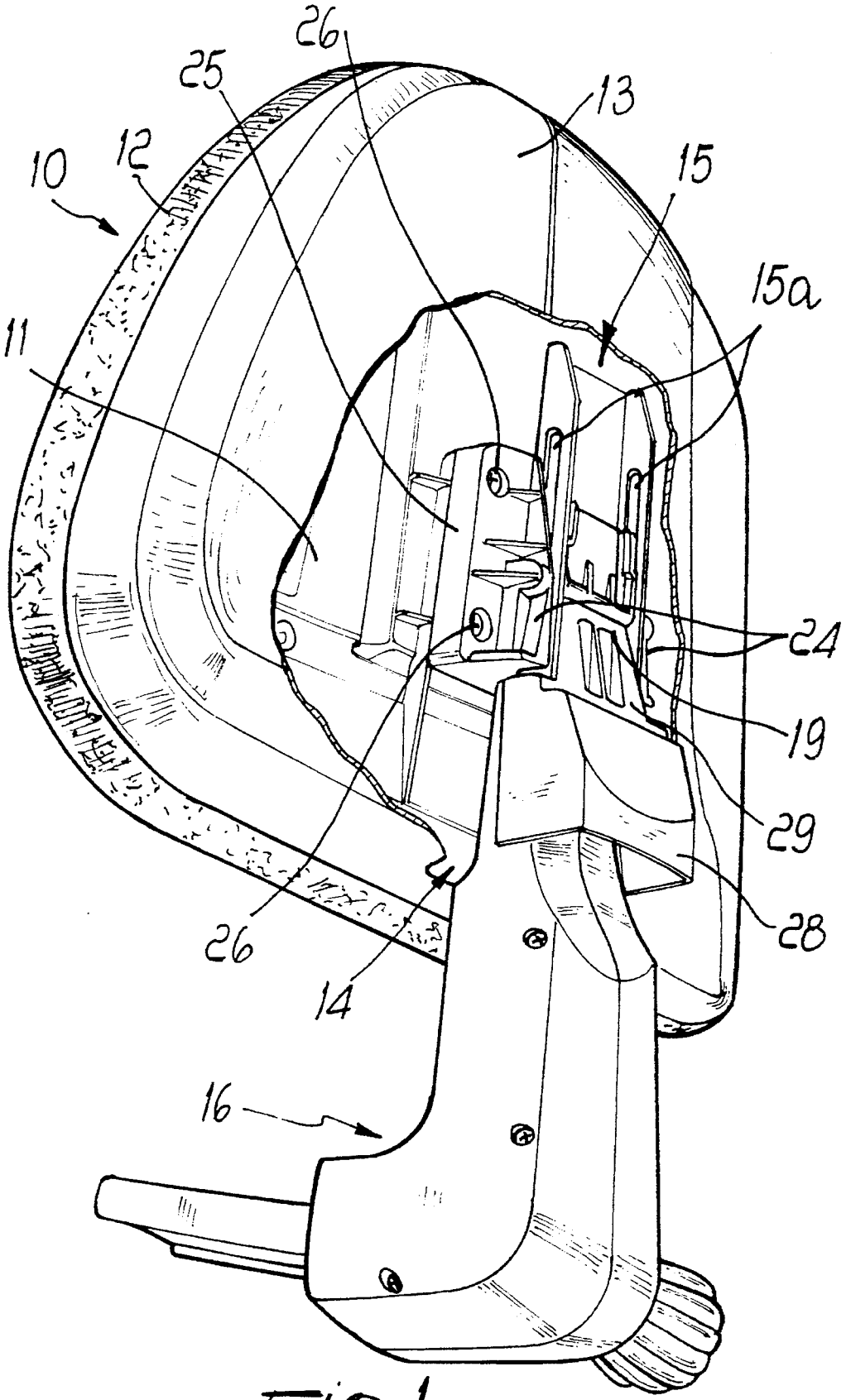
FIG. 1 is a partially cutout view from below of a back and of the support to which it is fixed.

With reference to the above figures, the back of a chair is generally designated by the reference numeral 10 and is composed of an internal shaped supporting plate 11, made for example of plastics, on top of which a padding with a covering 12 of fabric or other material is placed.

A covering shell 13 is fixed in a rearward region to said plate 11 and has, in a downward region, an opening 14 in which the vertical end 15 of an L-shaped support, generally designated by the reference numeral 16, is inserted for fixing; a seat, not shown in the figures for the sake of simplicity, is conveniently fixed to the other end of said L-shaped support.

According to the invention, two oppositely arranged elastically retractable coaxial pins 17 are rigidly coupled to said end 15 of the support 16.

In particular, said pins 17 are accommodated in a transverse through hole 18 of an element 19 made of plastics which is fixed to the end 15 at its bottom.

Each pin 17 has a wider disk-like end 20 that is slideable in a corresponding wider region 21 of the hole 18, and a cylindrical helical spring 22 is interposed between the two ends 20.

The pins 17 are conveniently rounded at their ends that protrude from the hole 18 and pass through the mutually facing wings of the end 15, which conveniently has a U-shaped cross-section and is made of metal, in suitable longitudinal slotted holes 15*a*.

The pins 17 are suitable to fit in corresponding seats 23 of guiding shoulders 24 which are substantially parallel and between which the end 15 is suitable to be inserted and guided; said shoulders extend from a base 25 made of plastics which is removably fixed to the plate 11 by means of screws 26.

The two shoulders 24 comprise mutually facing guiding channel paths having first upper ends, at the seats 23, and second lower ends at the region where the end 15 is inserted, so as to guide said end in the right direction for insertion. The channel paths are arranged along the shoulders 24 so as to diverge from the first upper ends to the second lower ends thereof for forcing the pins 17 to retract gradually, while guiding the end 15 upwards until said pins 17 are received and locked in the seats 23.

Figure 2:
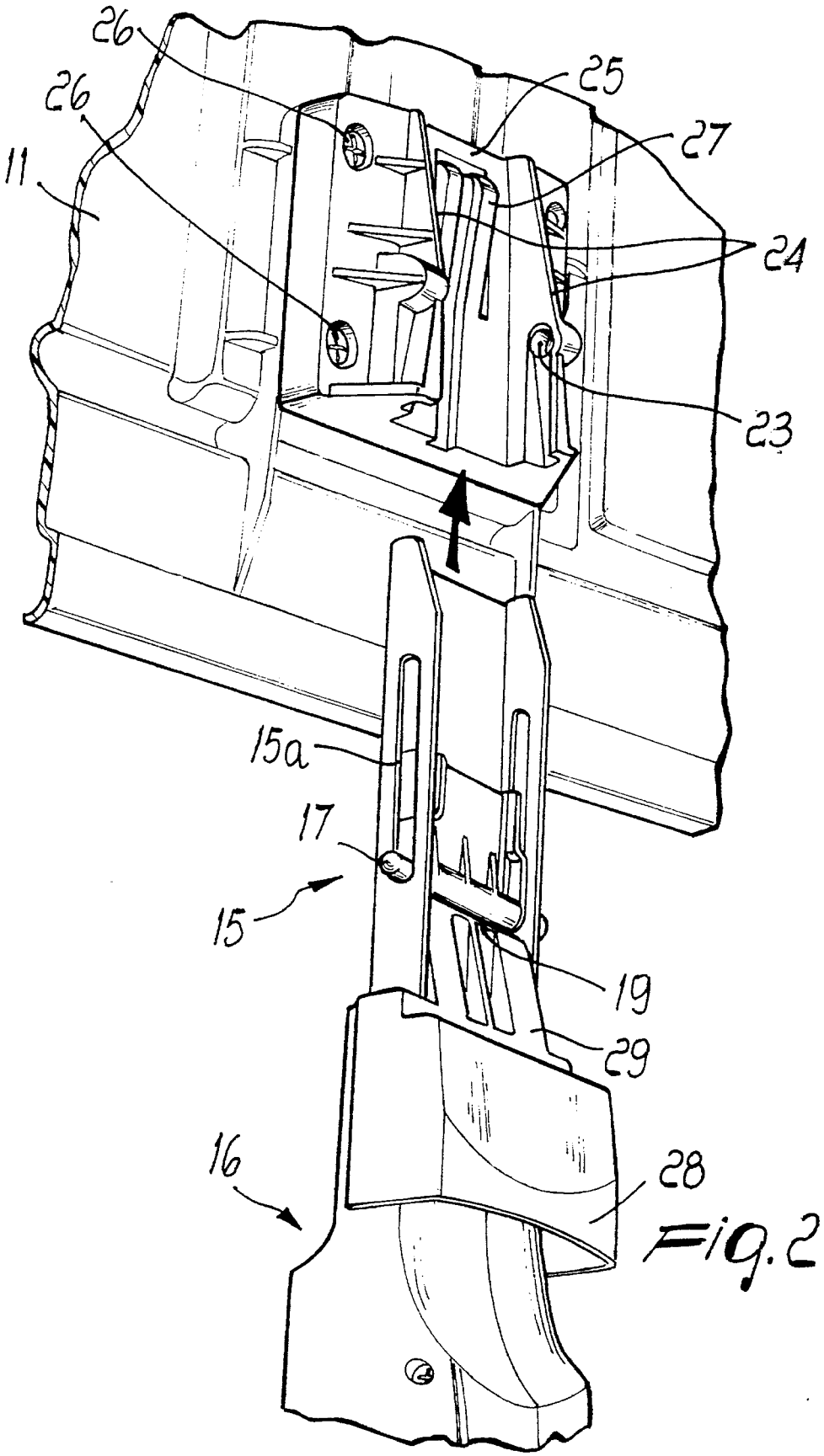
FIG. 2 is an enlarged-scale detail view of the elements that compose the device during fixing.
Figures 3, 4, 5:
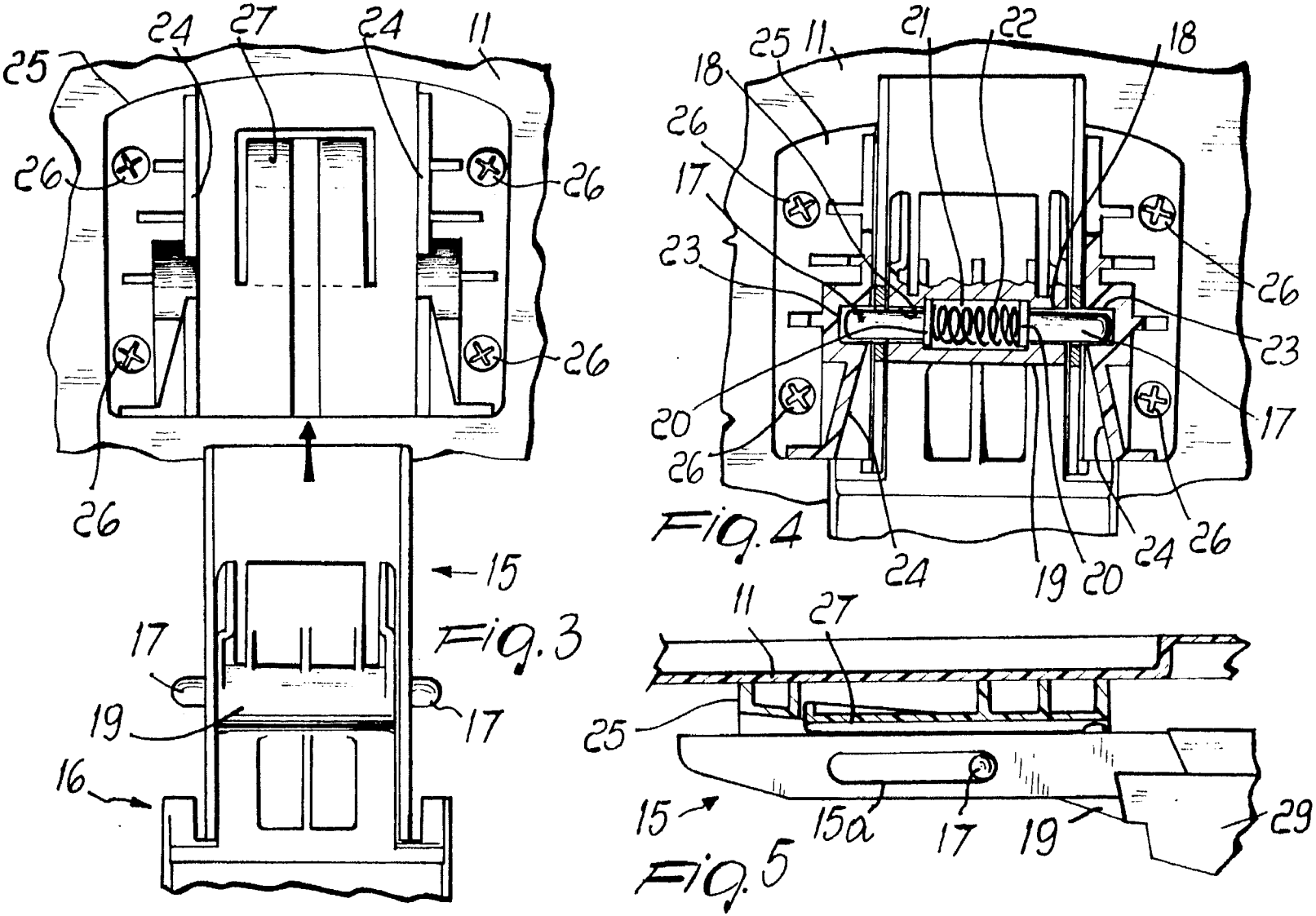
FIG. 3 is a partially sectional view of the elements of the fixing device, coupled to each other.
FIG. 4 is a partially sectional side view of the fixing device.
FIG. 5 is a view from below of the device during fixing.

As it will be noted in FIGS. 1, 2 and 5, the element 19 abuts on an inclined portion 29 of a stop element 28 arranged at the end 15 of the L-shaped support 16.

An elastic wing 27 is formed on said base 25 in the region where the end 15 rests; said wing is raised from said base and constitutes an element for elastically coupling the back 10 and the support 16.

From what has been described above it is therefore evident that the back can be assembled completely, by fixing the base 25 inside it, and can then be coupled to the support 16 simply by inserting the end 15 with the pins 17 between the shoulders 24 through the opening 14 of the shell 13.

This allows to eliminate considerable problems which currently occur in the field as regards assembly, adding advantages linked to easier storage and transport.

In practice it has been observed that the intended aim and objects of the present invention have been achieved.

In practice, the materials employed, so long as they are compatible with the contingent use, as well as the dimensions, may be any according to the requirements.

What is claimed is:

1. In combination a back for a chair and a fixing device for fixing the back of the chair to a supporting structure, the back having a supporting plate, and a covering shell fixed to said supporting plate, said shell being provided with an opening, said device comprising:

a support element for supporting the back of the chair, said support element having a vertical end portion, said end portion comprising slotted holes;

two oppositely arranged elastically retractable pins, said pins protruding through said slotted holes of said end portion;

a base fixed to said supporting plate of the back, said base having two substantially parallel guiding shoulders, said shoulders comprising two mutually facing guiding channel paths, said channel paths diverging from first upper ends thereof to second lower ends thereof, and two mutually facing seats, said seats being located at said first upper ends of said channel paths, said end portion being guidingly insertable through said opening of said shell with said pins being guided in said channel paths for gradually retracting between said second lower ends and said first upper ends of said channel paths for eventually being accommodated and locked in said seats.

2. The combination according to claim 1, wherein said retractable pins protrude from a transverse through hole of an element which is fixed to said end portion, said pins having corresponding wider ends that are slideable in a wider median region of said hole, a spring being arranged between said wider ends.

3. The combination according to claim 2, wherein said end portion has a U-shaped cross section with mutually facing wings, said slotted holes being arranged at said wings, and said element being fixed between said wings so that said pins protrude through said slotted holes.

4. The combination according to claim 2, further comprising a stop element, said stop element having an inclined portion on which said element with said through hole abuts.

5. The combination according to claim 1, wherein said base is made of plastics and is removably fixed to the supporting plate of said back.

6. The combination according to claim 1, wherein an elastic wing rises from said base in a region where said end portion of said support element rests, said wing constituting a springing element for said back.

7. The combination according to claim 1, wherein said end portion of the support element for supporting the back is made of metal.

8. The combination according to claim 1, wherein said base is concealed by said covering shell and can be accessed, for insertion of said end portion of the support element, through said opening of said shell, said opening being provided in a downward region of said covering shell.

9. In combination a back for a chair and a fixing device for fixing the back of the chair to a supporting structure, the back having a supporting plate, and a covering shell fixed to said supporting plate, said shell being provided with an opening, said device comprising:

a support element for supporting the back of the chair, said support element having a vertical end portion;

two oppositely arranged elastically retractable pins, said pins protruding laterally from said end portion;

a base fixed to said supporting plate of the back in a position being accessible through said opening of said covering shell, said base having two substantially parallel guiding shoulders, said shoulders comprising two mutually facing guiding channel paths, said paths diverging from first upper ends thereof to second lower ends thereof, and two mutually facing seats, said seats being located at said first upper ends of said channel paths, said end portion being guidingly insertable through said opening of said shell with said pins being guided along said channel paths for gradually retracting between said second lower ends and said first upper ends of said channel paths for eventually being accommodated and locked in said seats.

10. The combination according to claim 9, wherein said retractable pins protrude from a transverse through hole of an element which is fixed to said end portion, said pins having corresponding wider ends that are slideable in a wider median region of said hole, a spring being arranged between said wider ends.

11. The combination according to claim 10, wherein said end portion has a U-shaped cross section with mutually facing wings, slotted holes being arranged at said wings, and said element being fixed between said wings so that said pins protrude through said slotted holes.

12. The combination according to claim 10, wherein said pins are rounded at further ends thereof which are opposite to said wider ends, said rounded ends protruding through slotted holes and being guidingly slideable in said channel paths.

13. The combination according to claim 10, further comprising a stop element, said stop element having an inclined portion on which said element with said through hole abuts.

14. The combination according to claim 9, wherein said base is made of plastics and is removably fixed to the supporting plate of said back.

15. The combination according to claim 9, wherein an elastic wing rises from said base in a region where said end portion of said support element rests, said wing constituting a springing element for said back.

16. The combination according to claim 9, wherein said end portion of the support element for supporting the back is made of metal.

17. The combination according to claim 9, wherein said opening is provided in a downward region of said covering shell.

* * * * *